US010014606B2

(12) United States Patent
Yamanaka

(10) Patent No.: US 10,014,606 B2
(45) Date of Patent: Jul. 3, 2018

(54) PRESS-FIT TERMINAL AND BOARD CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Takuya Yamanaka, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/565,743

(22) PCT Filed: Mar. 24, 2016

(86) PCT No.: PCT/JP2016/059325
§ 371 (c)(1),
(2) Date: Oct. 11, 2017

(87) PCT Pub. No.: WO2016/167095
PCT Pub. Date: Oct. 20, 2016

(65) Prior Publication Data

US 2018/0083377 A1 Mar. 22, 2018

(30) Foreign Application Priority Data

Apr. 14, 2015 (JP) ..... 2015-082434

(51) Int. Cl.
*H01R 12/58* (2011.01)
*H01R 12/70* (2011.01)

(52) U.S. Cl.
CPC ..... *H01R 12/7064* (2013.01); *H01R 12/585* (2013.01)

(58) Field of Classification Search
CPC ..... H01R 12/7064; H01R 12/585
See application file for complete search history.

(56) References Cited

U.S. PATENT DOCUMENTS 4,606,589 A * 8/1986 Elsbree, Jr. ..... H01R 12/585 439/751
4,795,378 A * 1/1989 Tomizu ..... H01R 12/585 439/751

(Continued)

FOREIGN PATENT DOCUMENTS

JP 64-40175 3/1989
JP 2001-148261 5/2001

(Continued)

OTHER PUBLICATIONS

International Search Report dated Jun. 14, 2016.

*Primary Examiner* — Briggitte R Hammond
(74) *Attorney, Agent, or Firm* — Gerald E. Hespos; Michael J. Porco; Matthew T. Hespos

(57) ABSTRACT

A press-fit terminal held in a through hole provided in a board by being inserted into the through hole along an inserting direction includes a first contacting portion and a second contacting portion configured to resiliently contact an inner peripheral surface of the through hole. A value obtained by dividing a radius of curvature of the second contacting portion by a radius of curvature of the first contacting portion is 0.75 or smaller in a cross-sectional view perpendicular to the inserting direction. By providing the first and second contacting portions adjacent between adjacent press-fit terminals, a contact part where a contact pressure applied to the inner peripheral surface is small and a contact part where a contact pressure applied to the inner (Continued)

peripheral surface is large are adjacent between adjacent through holes. Thus, it can be suppressed that damaged parts of the board approach between the adjacent through holes.

1 Claim, 5 Drawing Sheets

(56) References Cited

U.S. PATENT DOCUMENTS

| | | | | | |
|---|---|---|---|---|---|
| 5,154,621 | A * | 10/1992 | Legrady | H01R 12/58 | 439/75 |
| 5,738,550 | A * | 4/1998 | Sakuraoka | H01R 12/585 | 439/751 |
| 6,098,281 | A * | 8/2000 | Rudi | H01R 12/585 | 29/837 |
| 6,722,928 | B1 * | 4/2004 | Noda | H01R 12/585 | 439/751 |
| 6,969,261 | B2 * | 11/2005 | Harris | H01R 12/7088 | 439/65 |
| 8,992,235 | B2 * | 3/2015 | Kataoka | H01R 12/585 | 439/751 |
| 2008/0166928 | A1 * | 7/2008 | Tang | H01R 12/585 | 439/751 |
| 2009/0068887 | A1 * | 3/2009 | Ito | H01R 23/6873 | 439/607.05 |

FOREIGN PATENT DOCUMENTS

| | | |
|---|---|---|
| JP | 2007-059106 | 3/2007 |
| WO | 2008/038331 | 4/2008 |

* cited by examiner

| $R_2/R_1$ [%] | JUDGEMENT |
|---|---|
| 20 | ○ |
| 40 | ○ |
| 60 | ○ |
| 75 | ○ |
| 100 | × |

PRESS-FIT TERMINAL AND BOARD CONNECTOR

BACKGROUND

Field of the Invention

The present invention relates to a press-fit terminal and a board connector.

Description of the Related Art

As shown in FIG. 7, a conventional press-fit terminal held in a through hole 122 of a circuit board to be incorporated into an electronic device, and electrically connected to a conductive circuit on the circuit board by being press-fit into the through hole 122 is known. A pair of facing portions 114 disposed to face each other in a width direction across a slit 110A are provided in a part of the press-fit terminal held in the through hole 12. The respective facing portions 114 are symmetrically shaped across the slit 110A. When a press-fit terminal 110 is press-fit into the through hole 122, contacting portions 114A of the respective facing portions 114 resiliently contact the inner peripheral surface of the through hole 122.

When the contacting portions 114A of the respective facing portions 114 resiliently contact the inner peripheral surface of the through hole 122, contact pressures are applied to the inner peripheral surface from the respective contacting portions 114A. Depending on the magnitudes of the contact pressures, a layer of the circuit board may be peeled near areas of the circuit board where the contact pressures were applied, and a surface of the circuit board may be whitened (parts indicated by D11 of FIG. 7; hereinafter, referred to as "board damaged parts"). Thus, if an interval between adjacent through holes 122 is narrow as shown in FIG. 7, the board damaged parts D11 may approach or contact each other to reduce insulation performance between the adjacent through holes 122.

International Publication No. 2008/038331 discloses a press-fit terminal for suppressing a reduction of insulation performance between adjacent through holes. In the press-fit terminal, by characterizing a size of each facing portion in the width direction and a length of each facing portion in a press-fitting direction, contact pressures applied to the through hole when the press-fit terminal is press-fit into the through hole are reduced to mitigate damage (whitening by the peeling of the above layer) given to a board from the contacting portions of the respective facing portions.

However, if the contact pressures are reduced, a holding force of the press-fit terminal held in the through hole is also reduced. Thus, it may not be possible to ensure sufficient connection reliability between the press-fit terminal and the circuit board provided with the through hole.

The present invention was created in view of the above problems and aims to suppress a reduction of insulation performance while ensuring connection reliability.

SUMMARY

A technique disclosed in this specification is directed to a press-fit terminal to be held in a through hole provided in a board by being inserted into the through hole along an inserting direction. The press-fit terminal includes a first contacting portion and a second contacting portion configured to resiliently contact an inner peripheral surface of the through hole, wherein a value obtained by dividing a radius of curvature of the second contacting portion by a radius of curvature of the first contacting portion is 0.75 or smaller in a cross-sectional view perpendicular to the inserting direction.

In the press-fit terminal, since the radius of curvature of the first contacting portion is larger than the radius of curvature of the second contacting portion, and the first contacting portion has a gentler arcuate shape in the cross-sectional view, a contact pressure applied to the inner peripheral surface on one side is smaller than that on the other side and the board is less damaged when the first contacting portion contacts the inner peripheral surface of the through hole. On the other hand, the second contacting portion, having a radius of curvature smaller than the first contacting portion, has a larger contact pressure applied to the inner peripheral surface than the first contacting portion when contacting the inner peripheral surface of the through hole. Thus, sufficient connection reliability can be ensured between the press-fit terminal and the through hole without reducing a holding force of the press-fit terminal held in the through hole.

By providing the first and second contacting portions such that the first and second contacting portions are adjacent between adjacent ones of the press-fit terminals, the first contacting portion of one press-fit terminal and the second contacting portion of the other press-fit terminal are adjacent between the adjacent through holes when the press-fit terminals are respectively inserted into the adjacent through holes. Specifically, a contact part where the contact pressure applied to the inner peripheral surface is small and a contact part where the contact pressure applied to the inner peripheral surface is large are adjacent between the adjacent through holes. In other words, the contact part of a through hole that is less damaging to the board and the contact part of an adjacent through hole that is more damaging to the board are adjacent to each other.

Thus, instances in which the contact parts of adjacent through holes that are relatively more damaging to the board are reduced. As a result, largely damaged parts of the board between the adjacent through holes can be avoided and a reduction of insulation performance due to the damaged parts between the adjacent through holes can be suppressed as compared to a configuration in which contact parts having a large contact pressure are adjacent between adjacent through holes.

Further, an experiment of the present inventor found that a sufficient resistance value was exhibited between adjacent through holes when the above press-fit terminals were respectively inserted into the adjacent through holes if the ratio of the radius of curvature of the second contacting portion to that of the first contacting portion was 75% or lower. Thus, according to the configuration of the above press-fit terminal, specific values of the radius of curvature of the first contacting portion and that of the second contacting portion can be set to effectively suppress a reduction of insulation performance.

The above press-fit terminal may include a pair of facing portions disposed to face each other, the first and second contacting portions may be provided on each of the pair of facing portions, and a line segment connecting the first contacting portions and a line segment connecting the second contacting portions between the pair of facing portions may intersect in the cross-sectional view perpendicular to the inserting direction.

In the above press-fit terminal, the first and second contacting portions are arranged in an offset manner between the pair of facing portions in the cross-sectional view perpendicular to the inserting direction. Thus, it is possible to provide a specific configuration for the approach of the contact parts less damaging to the board and the contact parts more damaging to the board between the adjacent through holes when the above press-fit terminals are respectively inserted into the adjacent through holes.

Another technique disclosed in this specification is directed to a board connector with the above press-fit terminal to be connected to a terminal insertion hole of a board, and a housing capable of accommodating a plurality of the press-fit terminals.

According to the present invention, it is possible to suppress a reduction of insulation performance while ensuring connection reliability.

DETAILED DESCRIPTION

Figure 1:
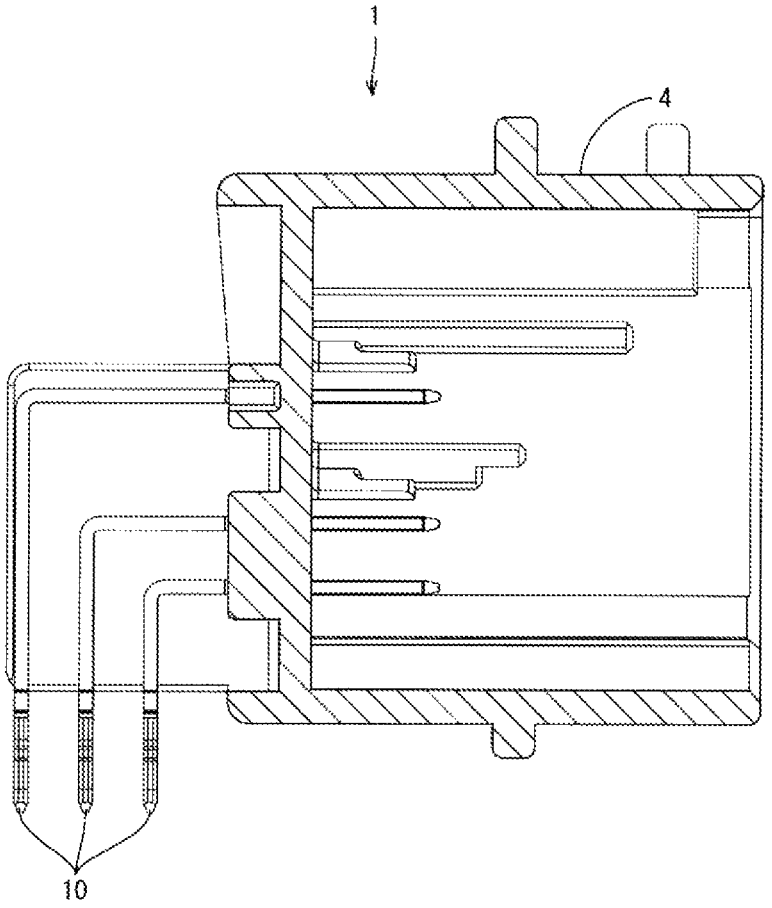
FIG. 1 is a side view in section of a board connector according to an embodiment.
Figure 2:
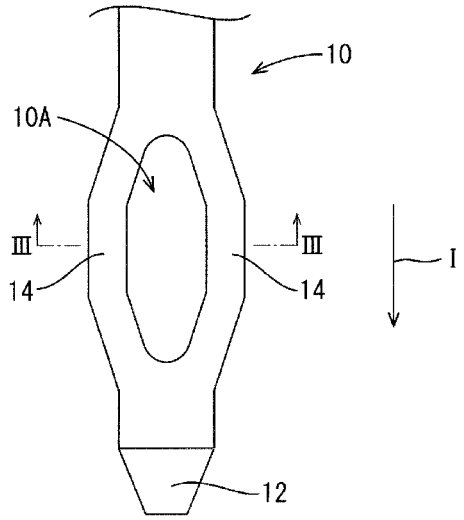
FIG. 2 is a plan view of a press-fit terminal.

An embodiment is described with reference to the drawings. In this embodiment, a board connector 1 and press-fit terminals 10 extending from the board connector 1 are illustrated as shown in FIG. 1. The board connector 1 is used as an in-vehicle electronic control device and includes a housing 4 made of resin, a plurality of press-fit terminals 10 extending from the housing 4 while being bent into an L shape, and the like. As shown in FIG. 2, each press-fit terminal 10 is formed into a long and narrow tab by press-working a metal plate material excellent in conductivity such as copper alloy.

Figure 4:
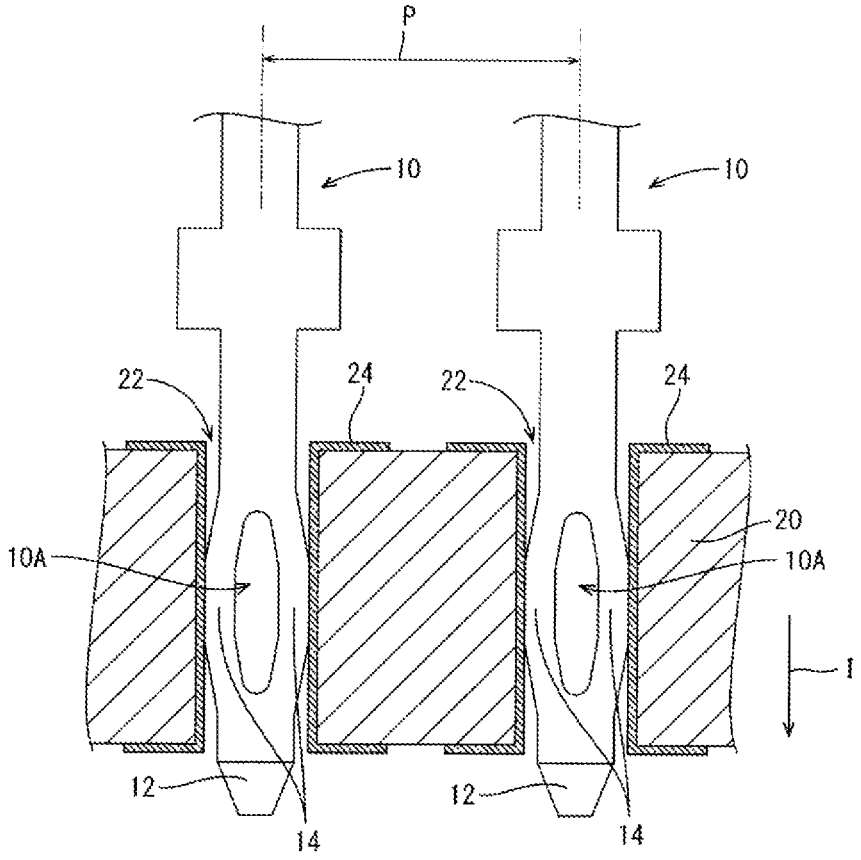
FIG. 4 is a side view in section showing press-fit terminals inserted in through holes.

One end side of each press-fit terminal 10 is mounted, for instance, by being press-fit into the housing 4 of the board connector 1 and the other end side thereof is inserted (press-fit) into a through hole 22 provided in a circuit board 20 to be incorporated into an in-vehicle electronic device. An example of a board is shown in FIG. 4. In the following description, an inserting direction (direction indicated by an arrow I) of the press-fit terminal 10 into the through hole 22 is referred to as a downward direction and a direction opposite to the inserting direction is referred to as an upward direction. Further, a lateral direction in FIGS. 2 and 4 is referred to as a width direction of the press-fit terminal 10.

As shown in FIG. 2, a tip part of each press-fit terminal 10 is tapered and serves as a guiding portion 12 for guiding the press-fit terminal 10 into the through hole 22. A pair of resiliently deflectable facing portions 14 disposed to face each other in the width direction across a slit 10A are provided above the guiding portion 12. Each press-fit terminal 10 is press-fit into the through hole 22, whereby the pair of facing portions 14 are resiliently deformed inwardly by being pressed by the inner peripheral surface of the through hole 22 and the press-fit terminal 10 is held in the through hole 22.

Figure 3:
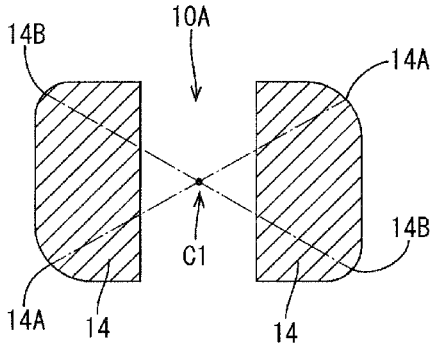
FIG. 3 is a section along III-III in FIG. 2.

Each of the pair of facing portions 14 has a substantially rectangular shape, two corner parts of which on both ends of one side (side opposite to the one facing the other facing portion 14) are chamfered to provide curvatures and the pair of facing portions 14 are point-symmetrically arranged with a center position C1 between the both facing portions 14 serving as a point of symmetry as shown in FIG. 3, when viewed in a cross-section perpendicular to the inserting direction of the press-fit terminal 10. The two parts of each facing portion 14 provided with the curvature respectively serve as a first contacting portion 14A and a second contacting portion 14B. These first and second contacting portions 14A, 14B resiliently contact the inner peripheral surface of the through hole 22 when the press-fit terminal 10 is inserted into the through hole 22.

As shown in FIG. 3, a radius of curvature of the first contacting portions 14A and that of the second contacting portions 14B differ in each press-fit terminal 10. Specifically, in each press-fit terminal 10, the radius of curvature of the first contacting portions 14A is set larger than that of the second contacting portions 14B such that a value obtained by dividing the radius of curvature of the second contacting portions 14B by that of the first contacting portions 14A is 0.75 or smaller. Note that since the both facing portions 14 are point-symmetrically shaped as described above, a line segment connecting the first contacting portions 14A and a line segment connecting the second contacting portions 14B intersect between the pair of facing portions 14 as shown in FIG. 3.

Since the radius of curvature of the first contacting portions 14A is larger than that of the second contacting portions 14B as described above, when the press-fit terminal 10 is inserted into the through hole 22 and the first and second contacting portions 14A, 14B resiliently contact the inner peripheral surface of the through hole 22, contact pressures applied to the inner peripheral surface from the second contacting portions 14B are more locally applied than contact pressures applied to the inner peripheral surface from the first contacting portions 14A. Thus, larger contact pressures are applied to the inner peripheral surface from the second contacting portions 14B as compared to the contact pressures applied to the inner peripheral surface from the first contacting portions 14A, and the second contacting portions 14B are satisfactorily held on the inner peripheral surface. As a result, a reduction of a holding force of the press-fit terminal 10 held in the through hole 22 is suppressed.

On the other hand, when the press-fit terminal 10 is inserted into the through hole 22, damage received by the circuit board 20 near parts where the contact pressures are applied from the first contacting portions 14A is smaller than damage received by the circuit board 20 near parts where the contact pressures are applied from the second contacting portions 14B since the contact pressures applied to the inner peripheral surface of the through hole 22 from the first contacting portions 14A are smaller than the contact pressures applied to the inner peripheral surface from the second contacting portions 14B.

Next, functions of the press-fit terminal 10 of this embodiment are described. A case where the press-fit terminals 10 are inserted into the through holes 22 of the circuit board 20, in which an interval P between adjacent through holes 22 is narrow is illustrated below. As shown in FIG. 4, a conductive path 24 having a contact portion, to which plating or the like is applied, is provided on the inner peripheral surface of the through hole 22.

When the press-fit terminal 10 is inserted into the through hole 22 of the circuit board 20 along the inserting direction with the guiding portion 12 in the lead, the first and second contacting portions 14A, 14B of each facing portion 14 butt against an opening end of the through hole 22 to be pressed. By further inserting the press-fit terminal into the through hole 22, the first and second contacting portions 14A, 14B of each facing portion 14 enter the through hole 22 and resiliently contact the inner peripheral surface (contact portion of the conductive path 24) of the through hole 22 while being resiliently deformed. In this way, the press-fit terminal 10 is electrically connected to the conductive path 24 of the circuit board 20.

Figures 5, 6:
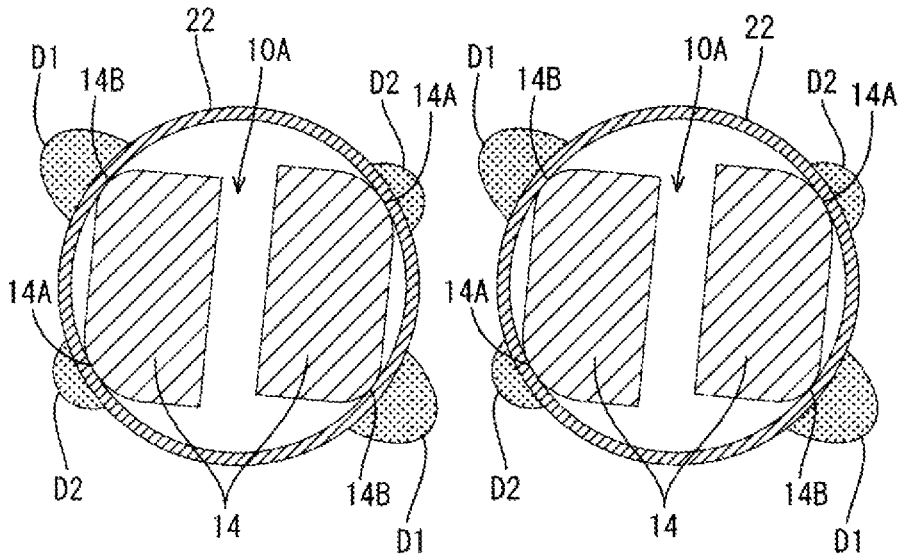
FIG. 5 is a section showing a contact state of the press-fit terminals with the through holes.
FIG. 6 is a table showing an evaluation result of a durability test.
Figure 7:
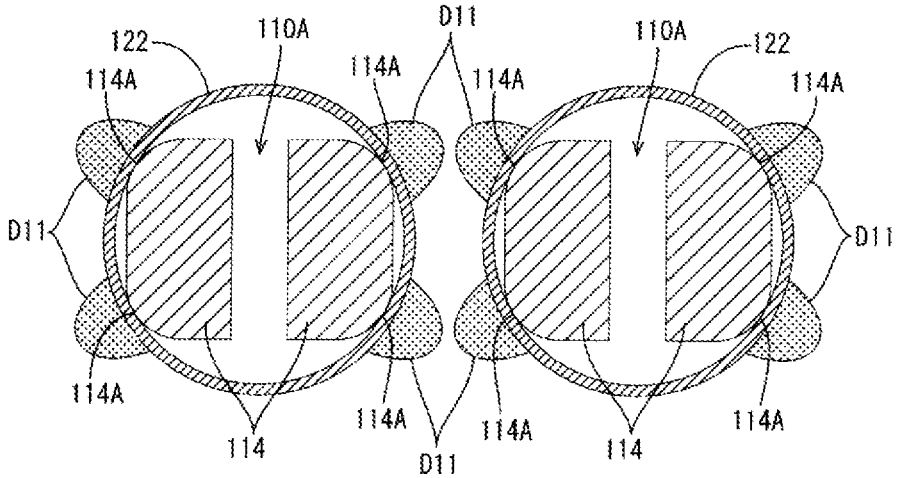
FIG. 7 is a section showing a contact state of conventional press-fit terminals with through holes.

Here, when the press-fit terminals 10 respectively inserted into the adjacent through holes 22 are viewed in a cross-section perpendicular to the inserting direction of the press-fit terminals 10, a part in contact with the first contacting portion 14A of one press-fit terminal 10 and a part in contact with the second contacting portion 14B of the other press-fit terminal 10 are adjacent between the adjacent through holes 22 as shown in FIG. 5. Thus, the parts in contact with the first contacting portions 14A and the parts in contact with the second contacting portions 14B are arranged in an offset manner between the adjacent through holes 22. Note that since the radius of curvature of the first contacting portions 14A and that of the second contacting portions 14B are different, the both facing portions 14 are slightly distorted in a state where the contacting portions 14A, 14B are in contact with the inner peripheral surface of the through hole 22.

Further, as described above, when the first and second contacting portions 14A, 14B contact the inner peripheral surface of the through hole 22, the damage received by the circuit board 20 due to the contact pressures from the first contacting portions 14A is smaller than the damage received by the circuit board 20 due to the contact pressures from the second contacting portions 14B. Thus, as shown in FIG. 5, second board damaged parts D2 of the circuit board 20 damaged by the contact pressures applied from the first contacting portions 14A are smaller than first board damaged parts D1 of the circuit board 20 damaged by the contact pressures applied from the second contacting portions 14B.

Thus, even if the parts in contact with the first contacting portions 14A and the parts in contact with the second contacting portions 14B are arranged in an offset manner and the both contact parts are adjacent between the adjacent through holes 22, the first board damaged parts D1 and the second board damaged parts D2 do not approach each other. Specifically, the approach of the both board damaged parts D1, D2 is suppressed. As a result, a reduction of insulation performance between the both through holes 22 due to the approach of the damaged parts of the circuit board 20 between the adjacent through holes 22 can be suppressed.

On the other hand, large contact pressures are applied to the inner peripheral surface of the through hole 22 from the second contacting portions 14B than from the first contacting portions 14A, whereby the second contacting portions 14B are satisfactorily held on the inner peripheral surface. Thus, sufficient connection reliability can be ensured between the press-fit terminal 10 and the through hole 22 without reducing the holding force of the press-fit terminal 10 held in the through hole 22. As described above, in the press-fit terminal 10 of this embodiment, it is possible to suppress a reduction of insulation performance while ensuring connection reliability.

Note that if the interval between the adjacent through holes 22 is narrow as in this embodiment, it is difficult to process each facing portion 14 of the press-fit terminal 10 into a complicated shape (e.g. polygonal cross-sectional shape). In contrast, each facing portion 14 of the press-fit terminal 10 of this embodiment has a substantially rectangular cross-sectional shape partially chamfered to provide the curvatures as described above. Thus, a complicated processing is not necessary to form each facing portion 14. Therefore, the press-fit terminal 10 of this embodiment can be realized regardless of the size of the interval between the adjacent through holes 22.

Modifications of the above embodiment are listed below.

(1) Although the respective facing portions of the press-fit terminal have a substantially rectangular cross-sectional shape in the above embodiment, the cross-sectional shapes of the respective facing portions are not limited.

(2) Although the slit is formed between the pair of facing portions in the press-fit terminal in the above embodiment, a configuration between the pair of facing portions is not limited. For example, a resilient member may be disposed between the pair of facing portions, whereby the respective facing portions may be configured to resiliently contact the inner peripheral surface of the through hole.

Although the embodiments have been described in detail above, these are merely illustrative and do not limit the scope of claims. Techniques described in claims include various modifications and changes of the specific example illustrated above.

EXAMPLES

Next, the technique disclosed in this specification is specifically described by way of an example. In the example, the press-fit terminals illustrated in the embodiment were respectively fit into two adjacent through holes provided in a circuit board, and a durability test for evaluating insulation performance between the adjacent through holes was conducted after this assembly was left for a fixed time in a high-temperature, high-humidity environment in a state where a direct-current voltage was applied between the both terminals.

In this durability test, PSL-2SPH produced by Espec Corp. was used as a thermohygrostat bath, and a temperature condition was set at 38 to 87° C., a humidity condition was set at 82 to 96% RH, a voltage to be applied between the both terminals was set at DC 5 to 100 V and a test time was set at a maximum of 1000 hr in accordance with JPCA standards. Further, evaluation was made with adjacent through holes arranged at a narrow interval and a ratio of a radius of curvature (R1) of first contacting portions to a radius of curvature (R2) of second contacting portions in each press-fit terminal varied between 20 to 100%.

In insulation performance evaluation, MY-40 produced by Yokogawa Meters & Instruments Corporation was used as an insulation resistance tester, and insulation performance was judged to be good (○) if a resistance value of insulation resistance between the adjacent through holes was larger than a maximum value of 2000 MS) measureable by the insulation resistance tester while being judged to be poor (×) if the resistance value of the insulation resistance is smaller than 2000 MΩ. The results are shown in a table of FIG. 6.

As shown in the table of FIG. 6, if the ratio of the radius of curvature of the second contacting portions to that of the first contacting portions was 75% or lower, i.e. if a value obtained by dividing the radius of curvature of the second contacting portions by that of the first contacting portions was 0.75 or smaller, good judgment (○) was made. From this result, specific values of the radius of curvature of the first contacting portions and that of the second contacting portions can be set to effectively suppress a reduction of insulation performance between the adjacent through holes for each press-fit terminal.

LIST OF REFERENCE SIGNS

1: board connector
10: press-fit terminal
14, 114: facing portion
14A: first contacting portion
14B: second contacting portion
20: circuit board
22, 122: through hole

The invention claimed is:

1. A board connector, comprising:

a press-fit terminal to be held in a through hole provided in a board by being inserted into the through hole along an inserting direction; and a housing capable of accommodating a plurality of the press-fit terminals;

wherein:

the press-fit terminal includes a first contact portion and a second contact portion configured to resiliently contact an inner peripheral surface of the through hole, a value obtained by dividing a radius of curvature of the second contact portion by a radius of curvature of the first contact portion is 0.75 or smaller in a cross-sectional view perpendicular to the inserting direction;

the press-fit terminal includes a pair of facing portions disposed to face each other;

the first and second contact portions are provided on each of the pair of facing portions;

a line segment connecting the first contact portions and a line segment connecting the second contact portions between the pair of facing portions intersect in the cross-sectional view perpendicular to the inserting direction; and parts in contact with the first contact portions and parts in contact with the second contact portions are arranged in an offset manner between adjacent ones of the through holes.

* * * * *